US005307750A

United States Patent [19]

Glassman et al.

[11] Patent Number: 5,307,750

[45] Date of Patent: May 3, 1994

[54] METHOD AND APPARATUS FOR CHAINING IN SEWING MACHINE

[76] Inventors: Alan J. C. Glassman, 1005 Oakmond Rd., Clarks Summit, Pa. 18411; Richard Musko, 13 Park View Dr., Plains, Pa. 18705; Joseph H. Hollander, 113 Abbey Dr., Clarks Summit, Pa. 18411

[21] Appl. No.: 997,545

[22] Filed: Dec. 28, 1992

[51] Int. Cl.[5] ..... D05B 19/00; D05B 47/04; D05B 27/14

[52] U.S. Cl. ..... 112/121.11; 112/255; 112/322; 112/262.1; 112/197

[58] Field of Search ..... 112/272, 273, 278, 121.11, 112/302, 254, 255, 197, 318, 320, 322, 287, 288, 262.1; 226/24, 34, 35, 42

[56] References Cited

U.S. PATENT DOCUMENTS 4,858,546 8/1989 Adamski et al. ..... 112/287 X
5,159,889 11/1992 Price et al. ..... 112/287 X

*Primary Examiner*—Clifford D. Crowder
*Assistant Examiner*—Paul C. Lewis

[57] ABSTRACT

An apparatus and method for maintaining the continuity of a free thread chain between successively sewn fabric parts by tensioning the free thread chain with a puller roller activated by drive means responsive to the sensing of the edges of the fabric parts.

8 Claims, 1 Drawing Sheet

FIG 1
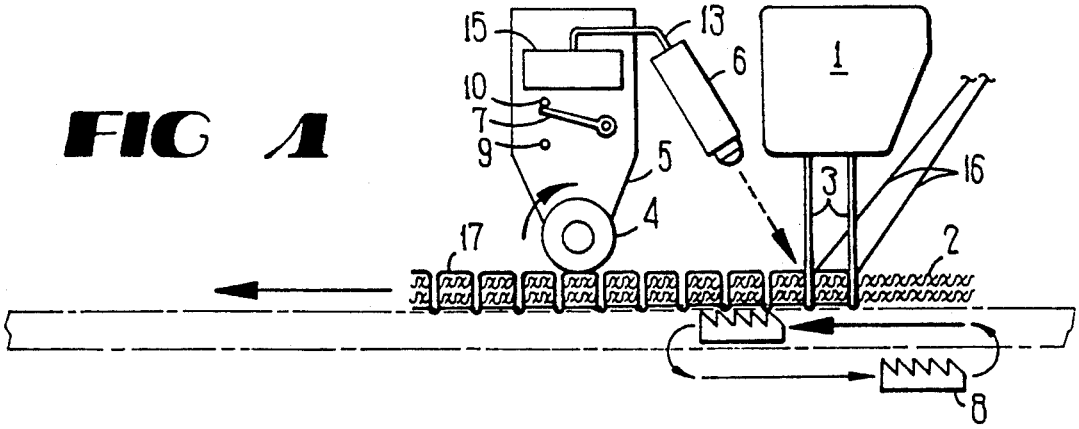
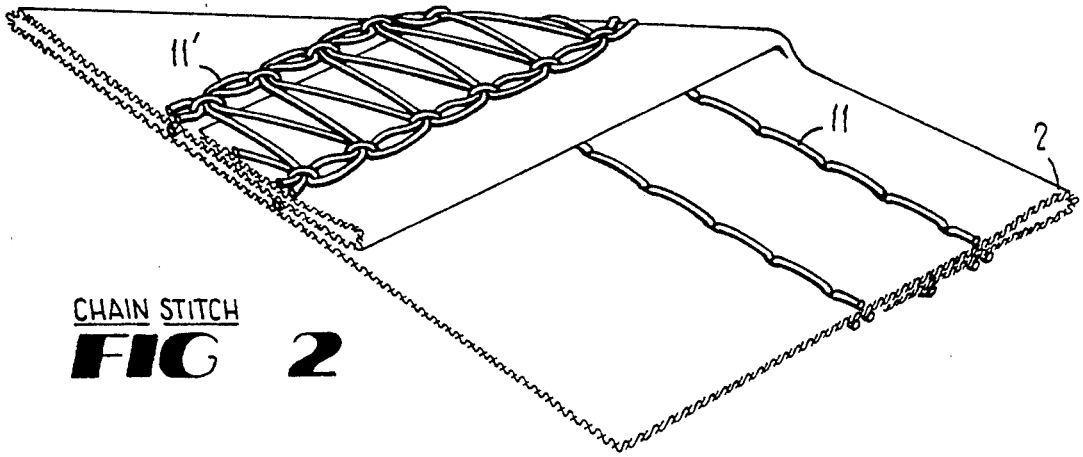
CHAIN STITCH
FIG 2
FIG 3
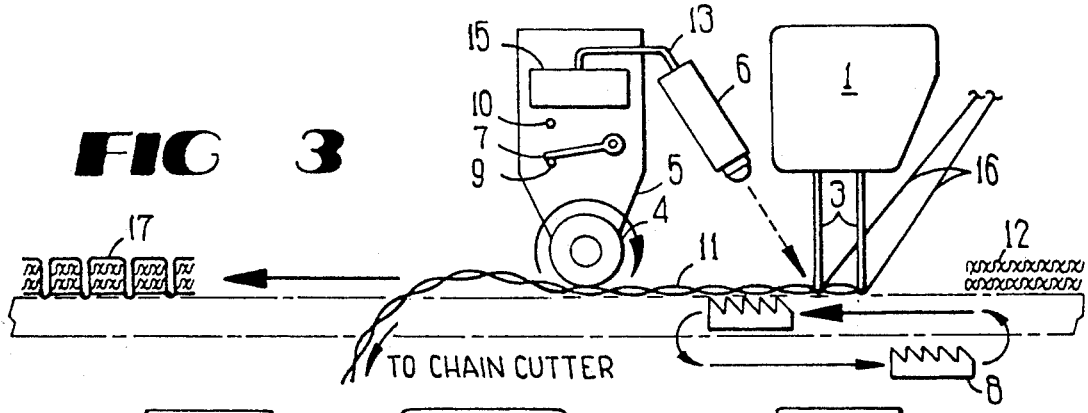
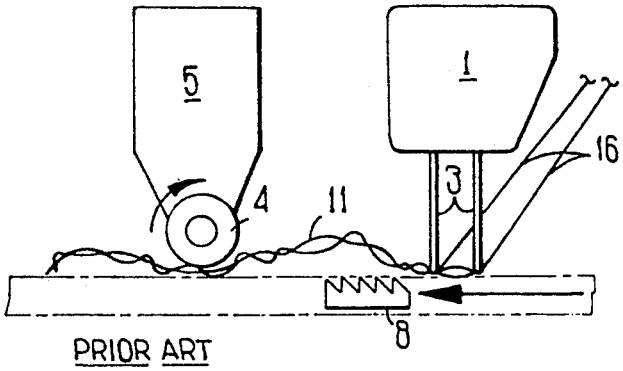
PRIOR ART
FIG 4
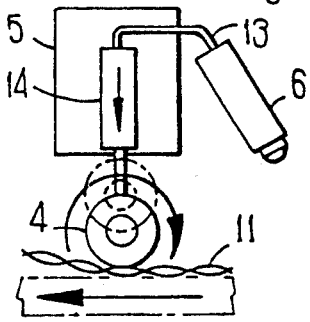
FIG 5

METHOD AND APPARATUS FOR CHAINING IN SEWING MACHINE

TECHNICAL FIELD

This invention relates to a method and means for maintaining the continuity and integrity of the thread chain between successive fabric pieces when stitched by a sewing machine.

BACKGROUND OF THE INVENTION

When compound pieces of fabric are sewn together, e.g., two different fabric pieces or parts such as a wool garment and a synthetic fiber lining, or two pieces of the same fabric, as in a hem, shirt pocket, etc., a complex stitch, generally referred to as a chain stitch, is used.

Illustratively, in a hemming operation, successive parts to be sewn are placed on a conveyor belt. The edges of the fabric part are trimmed with edge cutting devices, then folded to create the proper size hem. The fabric part then travels through the machine and is stitched. After exiting the machine the trailing chain of thread, which continues to be generated after the part is no longer under the presser foot and needles of the sewing machine, is cut off with a conventional type chain cutter. The completed, sewn, part is then removed from the conveyor and stacked.

In repetitive operations prevalent in industrial usage of sewing machines, difficulty has been encountered in maintaining the continuity of the thread chain so that when the succeeding fabric part is conveyed under the presser foot and the needles, the integrity of the thread chain between successive parts is sustained. With this continuity of the thread chain between parts, the next succeeding part may be stitched properly.

Historically, however, continuity of the chain between successive parts has presented difficulty, especially with certain texture threads. In the interval between stitching of successive parts, there is a tendency for the thread to break, tangle or separate from the needles. The conveyor and sewing machine must then be stopped and the sewing machine rethreaded, a time consuming procedure which disrupts production.

SUMMARY OF THE INVENTION

The foregoing problem of the prior art has been solved by a method and means for preserving the continuity and integrity of the thread chain between adjacent fabric parts by, illustratively, using pulling means, e.g., a roller directly behind the needles of the sewing machine in the direction of travel of the fabric parts to be sewn. The puller or roller frictionally engages the free thread chain generated by the needles and looping devices of the machine and is operated at a speed necessary to maintain the required tension on the chain to prevent tangling or breakage. The optimum speed is related to the thickness and texture of the thread.

The invention is implemented by sensing means, e.g., an electric eye, which detects when the trailing edge of a stitched fabric part moves out from under the needles. The sensing means initiates the actuation of the puller to engage the "free" thread chain, i.e., the thread chain itself, independent of any fabric part. The puller or roller is adjusted to maintain the appropriate tension on the free thread chain consistent with the texture and type of thread to insure continuity of the free thread chain, avoiding tangling or breakage.

BRIEF DESCRIPTION OF THE DRAWING

FIG. 1 is a schematic drawing of a sewing machine including a variable speed roller which is in continuous engagement with either a fabric part or a free thread chain;

FIG. 2 is a perspective view with a hem folded over to show the top and bottom views of a typical coverstitch;

FIG. 3 is a schematic view of the embodiment of FIG. 1 when the sewing machine is free thread chaining;

FIG. 4 is a schematic view of the prior art illustrating the entanglement of the thread chain prior to possible breakage or separation from the needles; and FIG. 5 is a schematic view of another embodiment of the invention in which the roller is engaged intermittently when the sewing machine is free thread chaining, i.e., when no fabric part is beneath the needles.

DETAILED DESCRIPTION

A more precise understanding of the invention may be afforded by reference to FIG. 1. A coverstitch machine 1 is shown in outline form. This type of sewing machine produces a stitch suitable among other purposes for stitching hems on fabric.

An example of this category of machine is a Union Special machine Type 52800 or 57800 which produces Stitch Type 605 as defined in U.S. Government Specifications Booklet 751 A. FIG. 2 shows a completed 605 stitch.

In operation, the machine 1 is fed two-layered fabric articles 2, which are hemmed by conventional apparatus, not shown, i.e., a clean sharp edge of the fabric is cut and folded to form a hem before being fed by an operator or by other means to machine 1.

The machine 1 stitches the hem of the fabric 2 with needles 3 to form the 605 type coverstitch in a well known manner. Although two needles 3 and a single thread 16 for each is shown for clarity, those skilled in the art are aware that multiple threads from multiple spools are conventionally used and each needle (there may be more than two industrial machines) is supplied with thread from its respective spool. A puller roller 4 is driven by drive unit 5, which may, for example, be a standard electric motor variable speed drive unit.

Referring briefly to FIG. 2, a typical coverstitched hem is shown. The fabric part 2 has been hemmed as shown by the double layer and folded over to illustrate the visible, top portion 11 of the coverstitch and the "blind" or bottom portion 11' of the coverstitch.

In one illustration of the practice of the invention, the roller 4 is in frictional engagement with fabric 2 and works in conjunction with conventional feed dogs 8 of the sewing machine 1 to advance the fabric to the left as shown by the arrow in FIG. 1.

An edge sensor 6 which may be optical, i.e., infra red, visible light, laser or other, detects the presence or absence of fabric leaving the needles 3. In the interval between successive fabric parts, the machine 1 continues to free thread chain as will be shown later in connection with FIG. 3. A depiction of the conventional presser foot is omitted for clarity.

When the machine 1 is stitching fabric 2, sensor 6 energizes relay 15 through conventional electronic or electrical connector means 13. Relay 15 actuates armature 7 to terminal 10 which actuates drive unit 5 to rotate roller 4 at a speed matched to that of the advance of the fabric by the feed dogs 8.

When fabric part 2 is completely stitched, the stitched fabric 17 moves out from under the needles 3 as shown in FIG. 3. Sensor 6 detects this condition and over connector 13 actuates relay 15 releasing armature 7 to return by conventional means, e.g., spring pressure to terminal 9. This action increases the speed of the roller 4 (e.g., by means of a conventional variable speed motor, not shown) to apply sufficient tension on the coverstitch free thread "chain" 11 to maintain its integrity and prevent tangling and breakage while the machine 1 is chaining, i.e., generating the coverstitch thread chain of FIG. 2 in the interim period before the next fabric part 12 is inserted into machine 1, engaged by feed dogs 8 and stitched by needles 3.

In the embodiment of the invention shown, the roller 4 rotates in a clockwise direction and the speed of the roller is adjustable at both the increased speed and lower speed to be appropriate for the thickness and type of thread, e.g., cotton, polyester, floss, etc.

As shown in FIG. 3, the roller maintains tension on the thread chain 11 during the interval when no fabric part is being sewn by the needles 3 of machine 1. The continuous chain 11 is fed through conventional means to a chain cutter, not shown, which cuts and disposes of the chain which is formed in between the stitched fabric parts.

When the succeeding fabric part 12 is engaged by feed dogs 8 and needles 3 begin to stitch part 12, sensor 6 detects the fabric part 12 and relay 15 is again actuated over connector 13 to move armature 7 to the upper position 10 shown in FIG. 1. Roller 4 is now once more at a speed which is matched to the advance of the fabric by the feed dogs 8.

In another embodiment of the invention, shown in FIG. 5, a solenoid 14 in drive unit 5 is actuated over connector 13 by sensor 6 when fabric part 2 (or 12) is being sewn by needles 3 to lift roller 4 above the fabric part as shown in dotted outline. Thus, during the interval that the machine 1 is sewing rather than free thread chaining, fabric part 2 (or 12) is advanced by the feed dogs 8 alone. This may be done when the nature of the fabric parts is such that roller 4 is not required to cooperate with the feed dogs 8 to advance the fabric parts.

In this instance, when sensor 6 detects the movement of the fabric part out from under the needles and the machine 1 begins chaining of the free thread 11 in between fabric parts, solenoid 14 is actuated to lower roller 4 into frictional engagement with the thread chain 11. Roller 4 shown in the lowered position in solid outline is driven at a speed selected to maintain tension sufficient to prevent the chain 11 from tangling or breaking.

The difficulty encountered in the prior art is illustrated in FIG. 4. Some industrial machines have rollers 4. Others do not. If there is no roller, there is an inherent tendency for the free thread chain to tangle or break unless the correct tension is applied to the thread chain and the tension continued until the next fabric part appears under the needles. But even with a roller 4 which is intended in the prior art to assist the feed dogs in moving the fabric part, the roller 4 must, to operate properly, function at a speed which is related to that of the feed dogs. When there is no fabric part under the needles 3, and with no change in the speed of roller 4, as in the prior art, the tendency of the free thread chain 11 to become entangled is shown.

It is to be understood that, although industrial sewing machines which form relatively complex chains have been described, it is apparent that the invention may be used in residential sewing machines which have less intricate thread chains including a conventional thread through a single needle which engages another thread in a conventional bobbin.

Although, for clarity, roller 4 is shown schematically at a distance from needles 3 it is understood by those skilled in the art that roller 4, detector 6 and needles 3 are arranged to permit roller 4 to be contiguous to needles 3.

It is also to be understood that the above described arrangements are merely illustrative of the invention. Other arrangements may be devised by those skilled in the art which will embody the principles of the invention and fall within the spirit and scope thereof.

We claim:

1. In a sewing machine adapted to stitch successive fabric parts; tension controlling means for applying tension to a free thread chain; said tension controlling means including variable speed roller means for frictionally engaging said free thread chain and said fabric parts, drive means for operating said variable speed roller means; optical sensing means for detecting the presence or absence of said fabric parts; said drive means being responsive to the detection by said optical sensing means of said fabric parts to vary the speed of said roller means to a first speed coordinated with the speed of stitching of said fabric parts; and said drive means being further responsive to the detection by said optical sensing means of the absence of said fabric parts to vary the speed of said roller means to an increased speed for applying tension to said free thread chain to prevent tangling or breakage thereof.

2. In a sewing machine adapted to stitch successive fabric parts;

tension controlling means for preventing the breakage or tangling of a free thread chain between said successive fabric parts, said tension controlling means comprising:

sensing means for detecting the presence or absence of said fabric parts;

roller means for tensioning said free thread chain; and drive means responsive to said sensing means for activating said roller means.

3. The apparatus of claim 2, wherein said sensing means includes optical sensing means.

4. The apparatus of claim 2, wherein said drive means includes means responsive to said sensing means to activate said roller means at a first speed when said sensing means detects the presence of a fabric part and at a different speed when said sensing means detects the absence of a fabric part.

5. The apparatus of claim 2, wherein said drive means is responsive to said sensing means to activate said roller means when said sensing means detects the absence of a fabric part to engage said free thread chain and apply tension thereto, said drive means being further responsive to said sensing means when said sensing means detects the presence of a fabric part to activate said roller means to prevent engagement with said fabric part.

6. A method for insuring the continuity of a free thread chain between successive fabric parts as they progress through a sewing machine including a roller comprising the steps of:

sensing the presence or absence of a fabric part;

rotationally engaging said free thread chain with said roller in response to the sensing of the absence of a fabric part to prevent tangling or breakage of said free thread chain; and disengaging said roller from said fabric part in response to the sensing of the presence of a fabric part.

7. A method for insuring the continuity of a free thread chain between successive fabric parts as they progress through a sewing machine comprising the steps of:

sensing the presence or absence of a fabric part;

rotationally engaging said fabric part at a first speed coordinated with the speed of stitching of said fabric part in response to the presence of said fabric part; and rotationally engaging said free thread chain at a second speed in response to the absence of said fabric part.

8. In a sewing machine adapted to stitch successive fabric parts; tension controlling means for applying tension to a free thread chain; said tension controlling means including variable speed roller means for frictionally engaging said free thread chain and said fabric parts, drive means for operating said variable speed roller means; optical sensing means for detecting the presence or absence of said fabric parts; said drive means being responsive to the detection by said optical sensing means of said fabric parts to vary the speed of said roller means to a first speed coordinated with the speed of stitching of said fabric parts; and said drive means being further responsive to the detection by said optical sensing means of the absence of said fabric parts to vary the speed of said roller means to an increased speed for applying tension to said free thread chain to prevent tangling or breakage thereof.

* * * * *